US010155299B1

(12) United States Patent
Kim et al.

(10) Patent No.: US 10,155,299 B1
(45) Date of Patent: Dec. 18, 2018

(54) IMPELLER FOR A BLAST WHEEL MACHINE

(71) Applicant: WHEELABRATOR GROUP, INC., Golden, CO (US)

(72) Inventors: Douglas J. Kim, Newnan, GA (US); Jonathan M. Edwards, Newnan, GA (US)

(73) Assignee: WHEELABRATOR GROUP, INC., Golden, CO (US)

( * ) Notice: Subject to any disclaimer, the term of this patent is extended or adjusted under 35 U.S.C. 154(b) by 0 days.

(21) Appl. No.: 15/684,179

(22) Filed: Aug. 23, 2017

(51) Int. Cl.
*B24C 5/06* (2006.01)
*B24C 3/06* (2006.01)

(52) U.S. Cl.
CPC ..... *B24C 5/068* (2013.01); *B24C 3/06* (2013.01); *B24C 5/062* (2013.01)

(58) Field of Classification Search
CPC ..... B24C 5/068; B24C 5/06
USPC ..... 451/95, 96, 97, 98
See application file for complete search history.

(56) References Cited

U.S. PATENT DOCUMENTS

| | | | | |
|---|---|---|---|---|
| 2,224,153 | A * | 12/1940 | Guendling | B24C 5/068 451/95 |
| 4,723,379 | A | 2/1988 | Macmillan et al. | |
| 4,751,798 | A * | 6/1988 | McDade | B24C 5/06 416/220 A |
| 4,907,379 | A | 3/1990 | MacMillan | |
| 4,908,998 | A | 3/1990 | Watkin et al. | |
| 5,024,028 | A * | 6/1991 | Pierce | B24C 5/066 451/95 |
| 5,476,412 | A | 12/1995 | Stoltz | |
| 5,577,953 | A | 11/1996 | MacMillan | |
| 5,759,091 | A | 6/1998 | MacMillan | |
| 6,126,516 | A | 10/2000 | Barrier et al. | |
| 6,764,390 | B2 | 7/2004 | Holloway et al. | |
| 6,949,014 | B2 | 9/2005 | Barrier et al. | |
| 7,905,766 | B2 * | 3/2011 | Iwata | B24C 5/068 451/92 |
| 2009/0286456 | A1 | 11/2009 | Ito et al. | |
| 2017/0282331 | A1 | 10/2017 | Bitzel, Jr. et al. | |

FOREIGN PATENT DOCUMENTS

| | | | |
|---|---|---|---|
| EP | 2946882 | A1 | 11/2015 |
| WO | 2016048319 | A1 | 3/2016 |
| WO | 2017014767 | A1 | 1/2017 |
| WO | 2017061989 | A1 | 4/2017 |

OTHER PUBLICATIONS

Notification of Transmittal of the International Search Report and the Written Opinion of the International Searching Authority from corresponding PCT/US2018/042618 dated Sep. 24, 2018.

* cited by examiner

*Primary Examiner* — Robert Rose
(74) *Attorney, Agent, or Firm* — Lando & Anastasi, LLP

(57) ABSTRACT

An impeller for a centrifugal blast wheel machine includes a hub provided at one end of the impeller, with the hub being configured to be coupled to the motor. The hub further includes a ring provided at an opposite end of the hub, with the ring defining a media inlet to receive blast media. The impeller further includes a plurality of cylindrical vanes positioned between the hub and the ring. The plurality of cylindrical vanes is spaced from one another on peripheries of the hub and the ring. The plurality of cylindrical vanes defines a plurality of impeller media outlets constructed and arranged to allow egress of blast media upon rotation of the impeller.

20 Claims, 7 Drawing Sheets

IMPELLER FOR A BLAST WHEEL MACHINE

BACKGROUND OF THE DISCLOSURE

1. Field of the Disclosure

The present disclosure relates generally to abrasive blast wheels and methods for cleaning or treating surfaces of work pieces, and more particularly to an improved impeller designed to prevent abrasive from being crushed prior to being applied by a blast wheel and to improve a volume of abrasive being thrown at a treated surface by the blast wheel.

2. Discussion of Related Art

Centrifugal blast wheel machines generally include a rotatable wheel having a plate or a pair of spaced plates that carry radially extending blades. Particulate matter is discharged from a center of the blast wheel onto rotating surfaces of the blades, which propel the particulate matter against surfaces of a work piece to be cleaned or treated. Specifically, blast media is fed from a feed spout into a rotating impeller situated within a control cage at the center of the blast wheel. The media is fed from the impeller, though an opening in the control cage, and onto the heels or the inner ends of the rotating blades. The media travels along the faces of the blades and is thrown from the tips of the blades at the work piece surfaces to be treated.

From observation of the internal operation of blast wheels and through maintenance on the blast wheel, the internal control surfaces of the impeller and the control cage directly affect the shape of the flow onto the surface of the throwing blade, which can cause one edge of the blade to wear more than the other edge of the blade over time. The sharp edges of the conventional impeller vanes create shear points between the control cage opening and the impeller, which results in crushed abrasive media, and cause the media to congest within the impeller and not escape to the outer race of the control cage as easily.

SUMMARY OF THE DISCLOSURE

One aspect of the disclosure is directed to a centrifugal blast wheel machine comprising a wheel assembly having a plurality of blades configured to throw blast media introduced into the wheel assembly against a work piece. The machine further includes an impeller positioned about an axis of the wheel assembly. The impeller has a media inlet at one end adapted to receive blast media and a plurality of impeller media outlets constructed and arranged to allow egress of blast media upon rotation of the impeller. The machine further includes a motor coupled to the impeller to drive the rotation of the impeller and the wheel assembly and a control cage surrounding the impeller and secured to the wheel assembly. The control cage includes a cylindrical body defining an interior chamber. The cylindrical body has an opening formed therein to allow the egress of blast media from the interior chamber. The impeller includes a hub provided at one end of the impeller. The hub is configured to be coupled to the motor. A ring is provided at an opposite end of the hub, with the ring defining a media inlet to receive blast media. A plurality of cylindrical vanes is positioned between the hub and the ring, with the plurality of cylindrical vanes being spaced from one another on peripheries of the hub and the ring. The plurality of cylindrical vanes defines a plurality of impeller media outlets constructed and arranged to allow egress of blast media upon rotation of the impeller.

Embodiments of the machine further may include spacing the plurality of cylindrical vanes equidistant from one another on peripheries of the hub and the ring. The plurality of cylindrical vanes may be spaced from the control cage a predetermined distance. The predetermined distance may be at least 3 mm. The plurality of cylindrical vanes may include eight cylindrical vanes. Each cylindrical vane may have a diameter of 9 mm to 16 mm. Each vane of the plurality of cylindrical vanes may be spaced apart from one another with a center-to-center distance dictated by the number of vanes.

Another aspect of the disclosure is directed to an impeller for a centrifugal blast wheel machine. In one embodiment, the impeller comprises a hub provided at one end of the impeller, with the hub being configured to be coupled to the motor. The hub further includes a ring provided at an opposite end of the hub, with the ring defining a media inlet to receive blast media. The impeller further includes a plurality of cylindrical vanes positioned between the hub and the ring. The plurality of cylindrical vanes is spaced from one another on peripheries of the hub and the ring. The plurality of cylindrical vanes defines a plurality of impeller media outlets constructed and arranged to allow egress of blast media upon rotation of the impeller.

Embodiments of the impeller further may include spacing the plurality of cylindrical vanes equidistant from one another on peripheries of the hub and the ring. The plurality of cylindrical vanes may be spaced from a control cage a predetermined distance. The predetermined distance may be at least 3 mm. The plurality of cylindrical vanes may include eight cylindrical vanes. Each cylindrical vane may have a diameter of 9 mm to 16 mm. The plurality of cylindrical vanes may be spaced apart from one another with a center-to-center distance dictated by the number of vanes.

Yet another embodiment of the disclosure is directed to a method of operating a centrifugal blast wheel machine. In one embodiment, the method comprises: feeding blast media from a feed spout into an impeller of the centrifugal blast wheel machine; accelerating the blast media by rotating the impeller giving rise to a centrifugal force that moves the blast media in radial direction, away from an axis of the impeller; moving the blast media in a generally circular direction into a space between the impeller and a control cage; metering an amount of blast media through an opening of the control cage onto blades of a blast wheel; and moving the blast media along lengths of the blades to accelerate and throw the blast media toward a work piece. The impeller includes a hub provided at one end of the impeller, with the hub being configured to be coupled to the motor. The impeller further includes a ring provided at an opposite end of the hub, with the ring defining a media inlet to receive blast media. The impeller further includes a plurality of cylindrical vanes positioned between the hub and the ring. The plurality of cylindrical vanes is spaced from one another on peripheries of the hub and the ring, the plurality of cylindrical vanes defining a plurality of impeller media outlets constructed and arranged to allow egress of blast media upon rotation of the impeller.

Embodiments of the method further may include spacing the plurality of cylindrical vanes equidistant from one another on peripheries of the hub and the ring. The plurality of cylindrical vanes may be spaced from the control cage a predetermined distance. The predetermined distance may be at least 3 mm. The plurality of cylindrical vanes may include eight cylindrical vanes. Each cylindrical vane may have a diameter of 9 mm to 16 mm.

BRIEF DESCRIPTION OF THE DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

The blast wheel of embodiments of the present disclosure is designed to throw metallic shot, grit, cut wire, etc., which together may be referred to as "abrasive," "abrasive blast media," "abrasive media," "blast media," "media" or any suitable description of particulate matter. The blast wheel machine typically consists of four primary components that act in conjunction to throw the media at a target object to be cleaned, peened or otherwise have its surface prepared. An impeller acts to accelerate the abrasive media once the media is fed into a wheel assembly. The impeller rotates within the interior of a control cage, which may also be referred to as an "impeller case." The control cage acts to meter the abrasive blast media flow through an opening formed in the control cage to direct the flow of media onto rotating blades by adjusting the position of the opening. The control cage is stationary within the blast wheel under operating conditions. The blades (generally from two to twelve in number) rotate outside of the control cage and propel the abrasive blast media along their radial length toward the target. A bare wheel, which may also be referred to as a "runner head" or simply as a "wheel," holds the impeller and blades, and typically rotates the impeller and blades between 1500-3600 revolutions per minute (rpm) by way of a power source, which in one embodiment is an electric motor.

Embodiments of the present disclosure are directed to an improved impeller that is configured to prevent abrasive from being crushed between the sheering surfaces of the control cage and the impeller vanes, and to maximize the volume of abrasive that can be moved to the throwing surface of the blade from the impeller.

Figure 1:
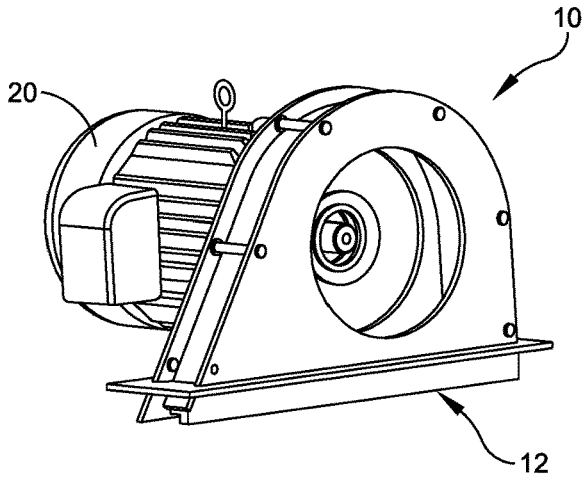
FIG. 1 is a perspective view of a portion of a centrifugal blast wheel machine.
Figure 2:
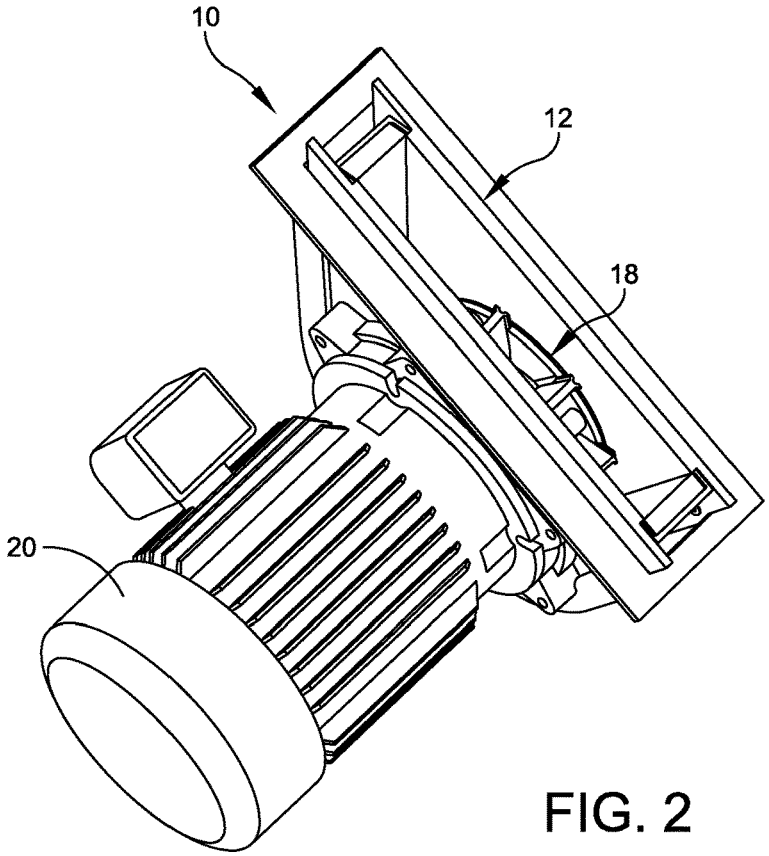
FIG. 2 is another perspective view of the centrifugal blast wheel machine.
Figure 3:
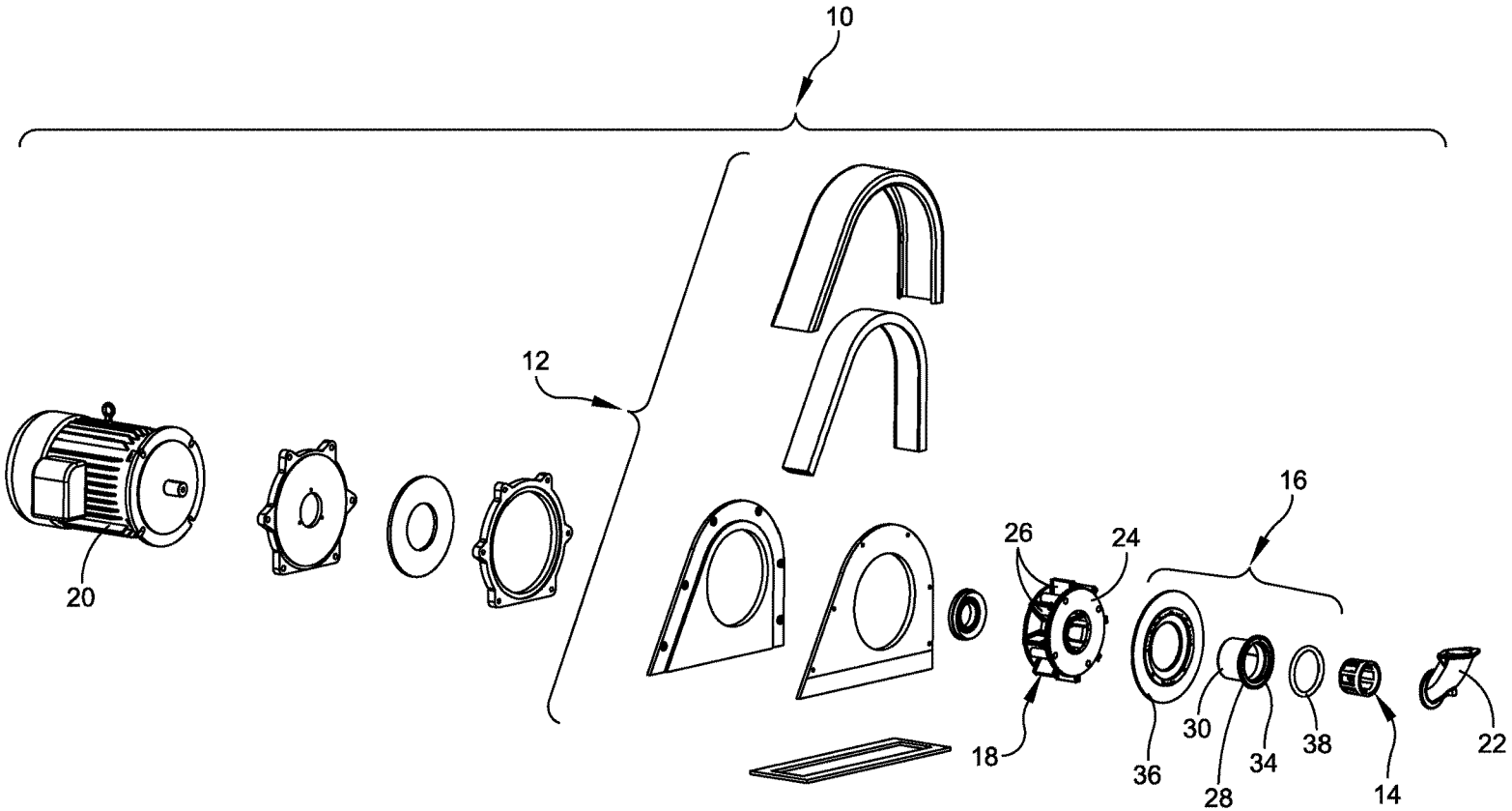
FIG. 3 is an exploded perspective view of the centrifugal blast wheel machine.

Referring to the drawings, and more particularly to FIGS. 1-3, a centrifugal blast wheel machine is generally indicated at 10. In one embodiment, the centrifugal blast wheel machine 10 includes a housing, generally indicated at 12, which is designed to house the components of the centrifugal blast wheel machine. The centrifugal blast wheel machine 10 further includes a rotating impeller, generally indicated at 14, supported by a drive shaft, a control cage assembly, generally indicated at 16, which surrounds the impeller, and a blast wheel assembly, generally indicated at 18, which receives the control cage assembly. A motor 20 is provided to drive the rotation of the impeller 14 and the blast wheel assembly 18. The arrangement is such that blast media is fed from a feed spout 22 into the rotating impeller 14, which is driven by the motor 20. By contact with vanes of the rotating impeller 14 (as well as with other particles of media already in the impeller), blast media particles are accelerated, giving rise to a centrifugal force that moves the particles in radial direction, away from the axis of the impeller. The blast media particles, now moving in a generally circular direction as well as outwards, move through openings formed in the impeller 14 into a space between the impeller and a control cage of the control cage assembly 16, still being carried by the movement of the impeller vanes (also known as impellor dams) and the other particles.

When the blast media particles that have passed though the impeller openings into the space between the impeller 14 and the control cage assembly 16 reach an opening provided in the control cage assembly, rotational and centrifugal forces move the particles through the opening. The control cage assembly 16 functions to meter a consistent and appropriate amount of blast media onto the blades of the blast wheel assembly 18. As the vanes of the impeller 14 rotate, the blast media particles are moved along their lengths and accelerate until they reach the ends of the vanes and thrown from the ends of the vanes. Although the impeller 14 is shown to be cylindrical in shape, the size and thickness of the impeller may vary depending on the size of a blast wheel assembly and the desired performance characteristics. For example, the impeller 14 may have interior or exterior walls that taper in either direction along its axis. Typically, the impeller will be made of a ferrous material, such as cast or machined iron or steel, although other materials may also be appropriate. In one particular embodiment, the impeller is formed of cast white iron. The particular construction of the impeller 14 will be described in greater detail below.

The blast wheel assembly 18 of the centrifugal blast wheel machine 10 includes a hub or wheel 24 and a plurality of blades, each indicated at 26, to throw blast media introduced into the wheel assembly to treat the work piece contained within the housing 12. The arrangement is such that the impeller 14 is positioned about an axis of the wheel 24 of the blast wheel assembly 18, with the impeller having a media inlet at one end adapted to receive blast media and a plurality of impeller media outlets constructed and arranged to allow egress of blast media upon rotation of the impeller. The control cage of the control cage assembly 16 surrounds the impeller 14 in a position in which the media outlet of the control cage assembly is adapted for passage of blast media to the heel ends of the blades of the blast wheel assembly 18. As mentioned above, the motor 20 is coupled to the impeller 14 and to the blast wheel assembly 18 by a drive shaft to drive the rotation of the impeller and the wheel assembly.

In one embodiment, the control cage assembly 16 includes a control cage 28 having a cylindrical wall 30 forming a housing defining an interior chamber and a media outlet or opening 32 formed in the cylindrical wall for allowing the egress of blast media from the interior chamber. A typical centrifugal blast wheel machine 10 having the control cage 28 is used to treat a surface (not shown) of a work piece by projecting blast media (not shown) at the surface. The treatment may be in the nature of cleaning, peening, abrading, eroding, de-burring, de-flashing, and the like, and the blast media typically consists of solid particles such as shot, grit, segments of wire, sodium bicarbonate, or other abrasives, depending on the surface being treated and/or the material being removed from the surface.

The control cage 28 of the control cage assembly 16, typically formed of cast iron (or similar material), is positioned concentrically around impeller 14 and, is approximately cylindrical in shape. Like the impeller 14, however, the control cage 28 may have other shapes, and may, for example, taper internally and/or externally in either direction along its axis. The control cage 28 also includes an outer flange or locking ring 34, which mates with an adaptor plate 36, which in turn is mounted on the wheel 24 of the blast wheel assembly 18, fixing the control cage with respect to the wheel and preventing the control cage from rotating with respect to the wheel upon operation of the blast wheel assembly 10. A retaining ring 38 is further provided to firmly secure the locking ring 34 and to prevent the rotational movement of the control cage 28 with respect to the adaptor plate 36 after securing the adaptor plate to the blast wheel 24 of the blast wheel assembly 18. The control cage 28 is then locked in place by placing the feed spout 22 onto the control cage and by firmly securing a feed spout bracket.

In other embodiments, the control cage 28 may be restrained from movement by attachment to other stationary elements of the blast wheel assembly 18 or its environment (as indicated above), or, in some cases, may be allowed to or made to rotate in one or both directions. As shown, one of two retaining rings 38 may be provided, with one of the retaining rings having markings or other indicia that allow a user to position the control cage 28 in a certain desired rotational orientation, so as to control the direction of the media being thrown by the blast wheel assembly 18.

As mentioned above, the media opening 32 of the control cage 28 allows egress of blast media upon operation of the blast wheel assembly 18. In the illustrated embodiment, the media opening 32 is approximately rectangular in shape when viewed from the side (i.e., in a direction perpendicular to its axis) and is approximately ⅗ the height of the cylindrical wall 30 of the control cage 28. The size, shape, and location of the media opening 32 may vary depending on the application, however. The length of the media opening 32 is measured in degrees, from the innermost portion of the opening furthest ahead in the direction of rotation to the outermost edge of the trailing portion. While the media opening 32 of the shown embodiment is approximately seventy degrees for a wheel rotating in either direction, in other embodiments, the length of the opening (in either direction) may vary, depending numerous factors such as the overall size of the blast wheel assembly 18, the nature of the media being thrown, and the desired rate of flow, as would be understood by one of skill in the art.

The blast wheel assembly 18, which is arranged concentrically around control cage 28, includes the plurality of blades 26 sandwiched between a rear wheel and a front wheel of the wheel 24 of the wheel assembly. The various parts of blast wheel assembly 18 are typically formed of cast iron, although they may also be made of any other appropriate material and/or method. The blast wheel assembly 18 is connected to the motor 20, in this embodiment by means of key inserted to lock a drive shaft of motor to the rear wheel of the wheel assembly, so that wheel assembly may be rotated by motor during operation of the blast wheel assembly. Blades 26, each of which have a heel end and a tip, are constructed and arranged to direct the blast media at the surface being treated. The blades 26 may be of any suitable size and any suitable shape, including one or more of straight, curved, flared, flat, concave, or convex shapes.

In one embodiment, the blades 26 may embody semi-curved blades, each blade having a curved portion positioned adjacent a central hub of the wheel assembly 18, and a straight portion integrally formed with the curved portion extending radially outwardly from the wheel assembly.

The invention is primarily focused on blast wheel applications that throw metallic shot, grit, cut wire, etc. As discussed above, a blast wheel typically consists of four primary components that act in conjunction to throw the blast media at a target object to be cleaned, peened or otherwise have its surface prepared. These components are the impeller 14, the control cage 28, the blades 26, and the blast wheel 24.

The operation of the centrifugal blast wheel machine 10 is as follows. The blast media is fed from the feed spout 22 into the rotating impeller 14. By contact with the rotating impeller vanes (as well as with other particles of media already in the impeller 14), the blast media particles are accelerated, giving rise to a centrifugal force that moves the particles in radial direction, away from the axis of the impeller. The blast media particles, now moving in a generally circular direction as well as outwards, move through the impeller openings into the space between the impeller 14 and the control cage 28, still being carried by the movement of the impeller vanes and the other particles.

When the blast media particles that have passed though the impeller openings into the space between the impeller 14 and the control cage 28 to the media opening 32, the rotational and centrifugal forces move the particles through the media opening and onto the heel ends of the blades 26. The control cage 28 functions to meter a consistent and appropriate amount of blast media onto the blades 26. As the blades 26 of the blast wheel 24 rotate, the blast media particles are moved along their lengths and accelerate until they reach the tips, at which point they are thrown from the ends of the blades toward the work piece.

Figure 4:
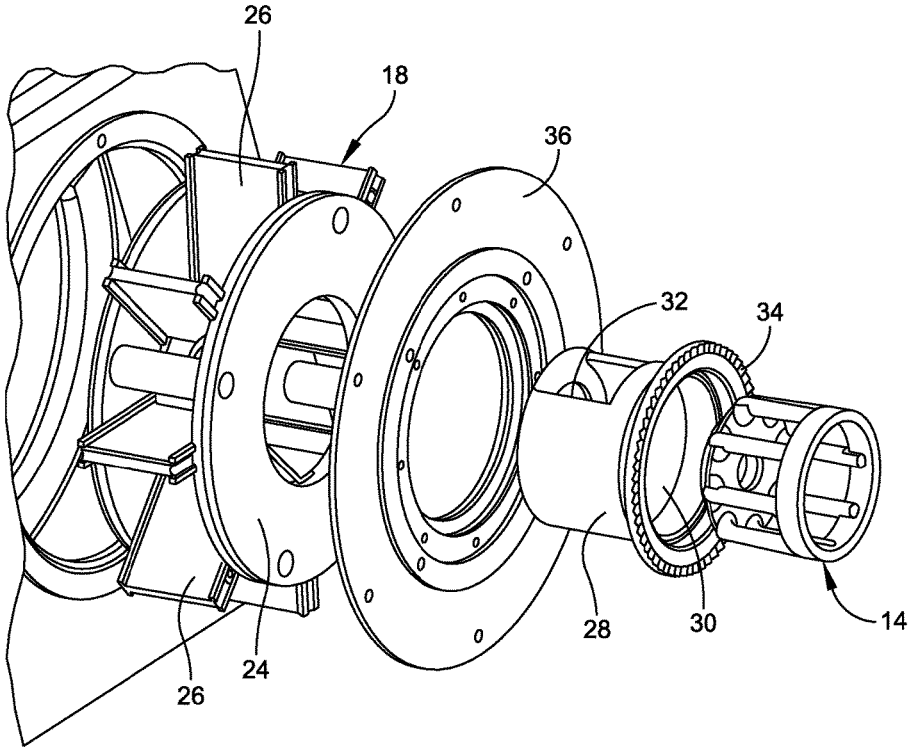
FIG. 4 is an exploded perspective view of a portion of a centrifugal blast wheel machine.

FIG. 4 illustrates the relationship of the impeller 14, the control cage 28 and the blast wheel assembly 18 prior to assembly. As shown, the impeller 14 fits within the body 30 of the control cage 28, which in turn fits within the blast wheel 24 of the blast wheel assembly 18. As will be shown in greater detail below, the impeller 14 includes cylindrical vanes to prevent abrasive from being crushed between the sheering surfaces of the control cage and the impeller vanes. The cylindrical vanes of the impeller 14 further maximize the volume of abrasive that can be moved to the throwing surface of the blade from the impeller.

Referring to FIGS. 5-9, an embodiment of the impeller 14 will be described. As shown, the impeller 14 includes a hub 40 provided at one end of the impeller. The hub 40 embodies a cylindrical body having a central opening formed therein that receives a drive shaft from the motor 20, and is coupled to the drive shaft by a key or some other suitable coupling. The impeller 14 further includes a ring 44 provided at an opposite end of the hub. The ring 44 defines a media inlet 46 to receive blast media from the feed spout 22. The impeller 14 further includes a plurality of cylindrical vanes, each indicated at 48, positioned between the hub 40 and the ring 44. As shown, the cylindrical vanes 48 are spaced equidistant from one another on periphery of the impeller 14 defined by the hub 40 and the ring 44. The cylindrical vanes 48 define a plurality of impeller media outlets, each indicated at 50, constructed and arranged to allow egress of blast media upon rotation of the impeller 14.

Figure 5:
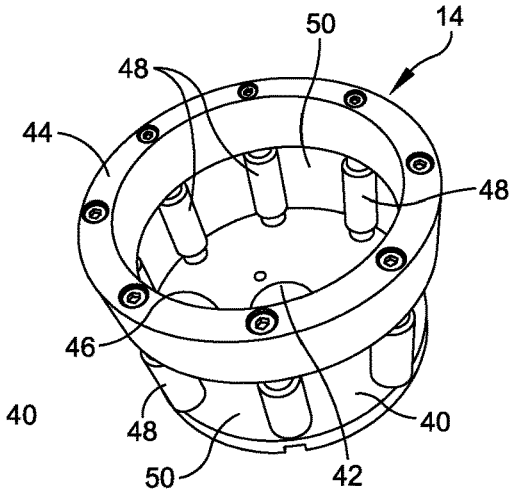
FIGS. 5 and 6 are perspective views of an impeller of an embodiment of the disclosure that is used in the centrifugal blast wheel machine.
Figure 6:
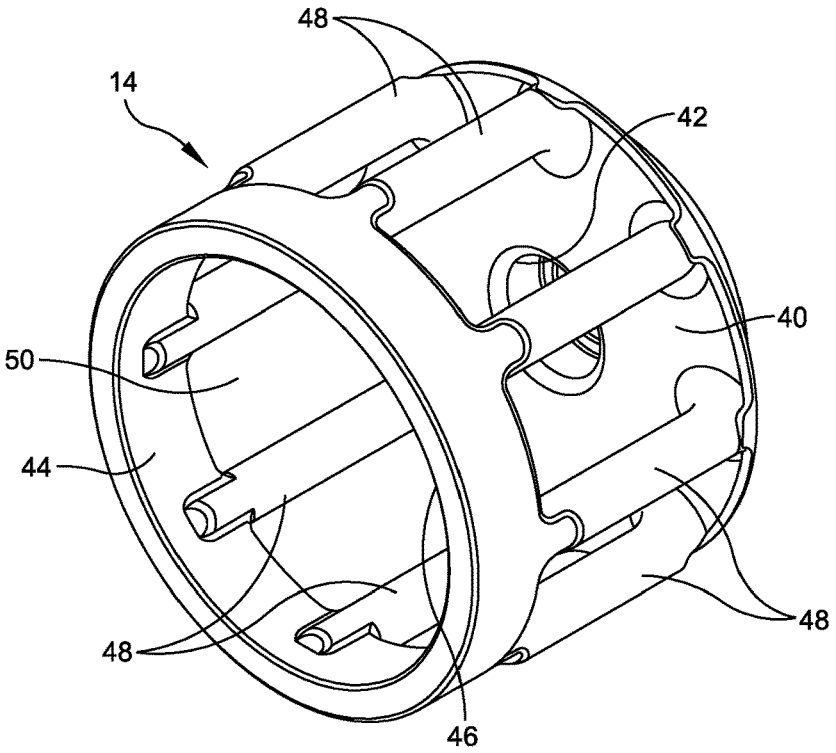
Figure 7:
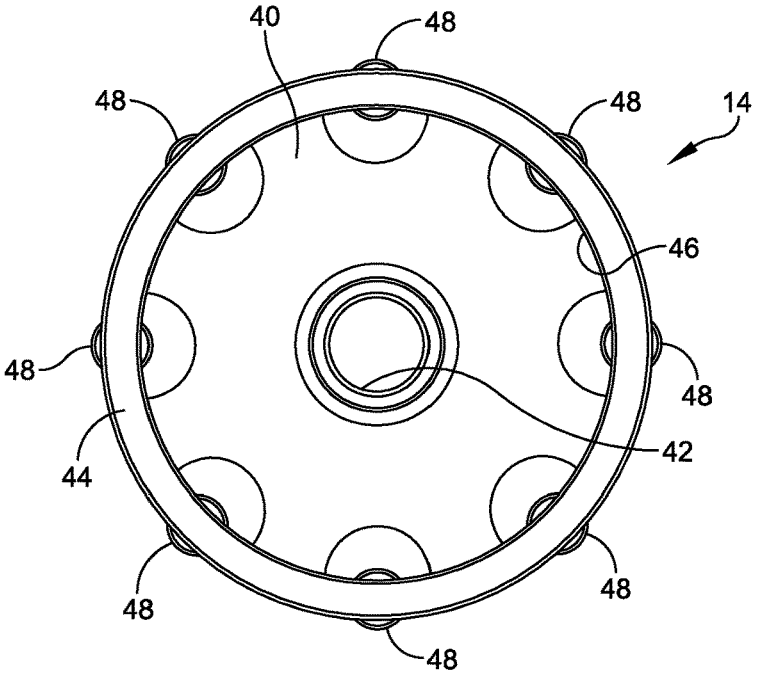
FIG. 7 is a front view of the impeller.
Figure 8:
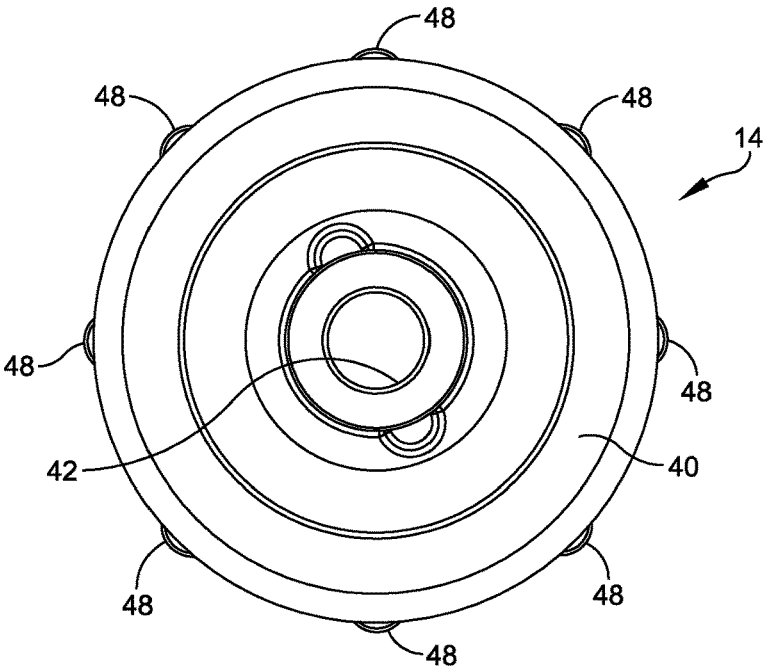
FIG. 8 is a back view of the impeller.
Figure 9:
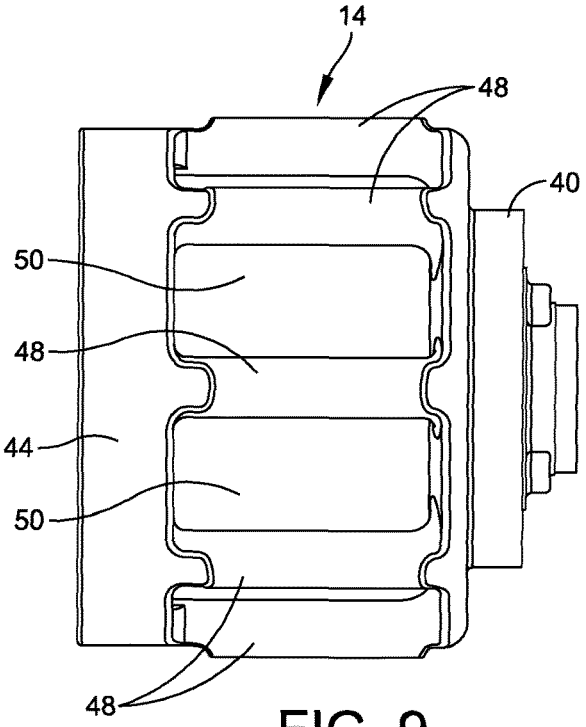
FIG. 9 is a side view of the impeller.

In one embodiment, the plurality of cylindrical vanes 48 includes eight cylindrical vanes, each having a diameter of 9 millimeters (mm) to 16 mm, with a preferred diameter of 14.3 mm. Since there are eight cylindrical vanes 48, there are thus eight media openings 50 between adjacently placed vanes. In one embodiment, the cylindrical vanes 48 are secured to their respective hub 40 and ring 44 by a bolt, e.g., a ¼-20 bolt (FIG. 5). As shown, the cylindrical vanes 48 are spaced equidistant from each other around a periphery of the impeller 14. In one embodiment, the cylindrical vanes 48 are spaced from each other in an equal circular pattern of eight or twelve, resulting in an angle of 45 degrees and 30 degrees, respectively. The cylindrical vanes are spaced apart from one another with a center-to-center distance dictated by the number of vanes. For example, a minimum linear center-to-center distance is 31 mm for twelve vanes, with an opening gap of approximately of 16 mm to 17 mm.

Figure 10:
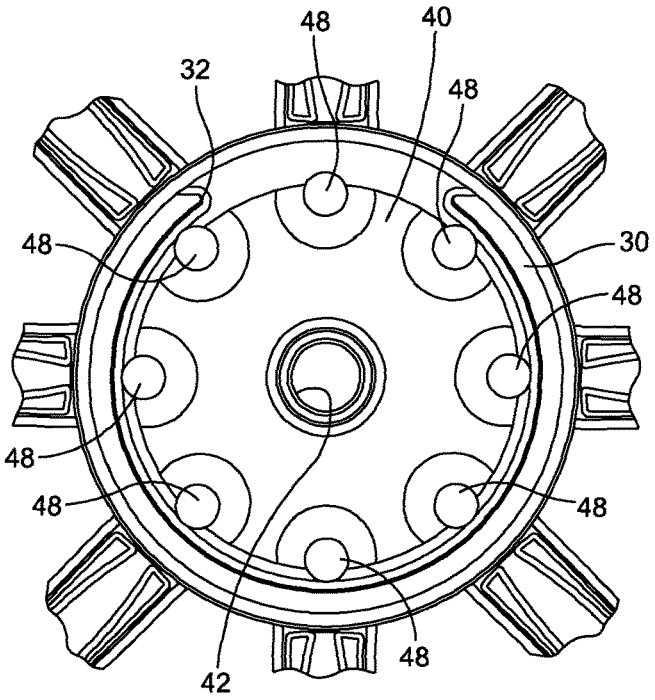
FIG. 10 is a front view of the impeller and a control cage of the centrifugal blast wheel machine.
Figure 11:
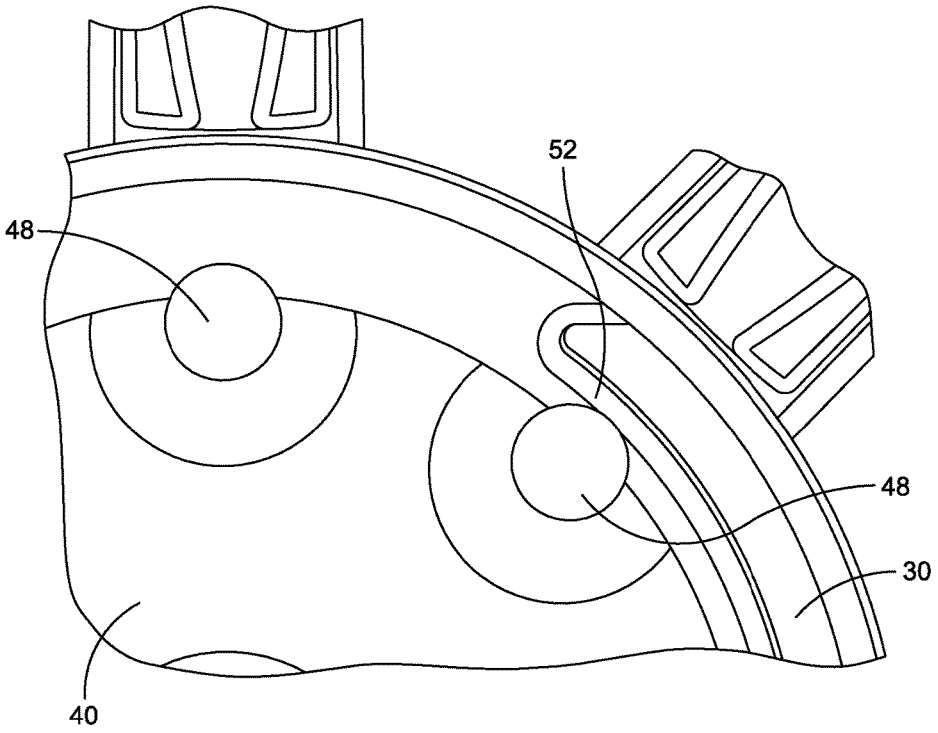
FIG. 11 is an enlarged portion of the impeller and the control cage shown in FIG. 10.

Referring additionally to FIGS. 10 and 11, the cylindrical vanes 48 are spaced from the control cage 28 a predetermined distance as indicated by 52 (FIG. 11). In one embodiment, the predetermined distance of the spacing is at least 3 mm. As described above, the arrangement is such that blast media fed into the impeller 14 from the feed spout 22 contacts the cylindrical vanes 48 of the rotating impeller and are accelerated to create a centrifugal force that moves the media particles in radial direction, away from the axis of the impeller. The blast media particles move through the media openings 50 formed in the impeller 14 into the space 52 between the impeller and the control cage 28 of the control cage assembly 16. When the blast media particles that have passed through the media openings 50 of the impeller 14 into the space between the impeller 14 and the control cage 28 reach the opening 32 provided in the control cage, rotational and centrifugal forces move the particles through the opening and to the blades 26 of the blast wheel assembly 18.

In some embodiments, a method of operating a centrifugal blast wheel machine includes feeding blast media from a feed spout into an impeller of the centrifugal blast wheel machine, accelerating the blast media by rotating the impeller giving rise to a centrifugal force that moves the blast media in radial direction, away from an axis of the impeller, moving the blast media in a generally circular direction into a space between the impeller and a control cage, metering an amount of blast media through an opening of the control cage onto blades of a blast wheel, and moving the blast media along lengths of the blades to accelerate and throw the blast media toward a work piece. In one embodiment, the method is performed using the impeller 14 having the cylindrical vanes shown and described herein.

The invention can be used on any known blast wheel in the industry that is used to throw metallic abrasive. To begin the impeller shape and relation to the internal face of the control cage is critical in minimizing the impedance on abrasive flow, the distance between the two control surfaces is a range of between 0.188 inches and 0.250 inches typically. In addition, the flow is affected by the way in which the impeller face is in relation to control cage internal face as the abrasive movement transitions from linear to rotational motion against the control cage internal face. The round cylindrical form of the impeller cylindrical vanes promotes the transition between the motions and improves the flow rate of the abrasive through the wheel.

Thus, it should be observed that an overall increase in efficiency of the throwing surface is in conjunction with the more efficient release of abrasive media from the impeller, which has been designed with optimal cylindrical vanes to improve the release of media into the control cage and onto the throwing blade surface, while minimizing the shear points between the impeller and the control cage opening onto the throwing blade.

Embodiments of the impeller produce a higher flow of abrasive media using the same level of power as previously achieved which is achieved by changing the impeller configuration to round vanes, which will also provide the second improvement of reducing the crushing between the sheer faces that normal vanned impellers have in relation to the control cage opening. The impeller is capable of providing better use of abrasive to perform the function of surface preparation or shot peening with a centrifugal wheel. The rounded vane of the impeller also reduces the crushing effect found between to sheer faces, as normally found in conventional impellers for blast wheels.

Embodiments of the impeller can be used on any of the impeller designs used within the industry, with varying shapes and sizes of control cage apertures. Moreover, the impeller van enables superior flow of media and the shape of the impeller promotes the reduction of abrasive being crushed between sharp cut offs that normal vanes create between the edges of the control cage opening and the impeller vanes.

Having thus described several aspects of at least one embodiment of this disclosure, it is to be appreciated various alterations, modifications, and improvements will readily occur to those skilled in the art. Such alterations, modifications, and improvements are intended to be part of this disclosure, and are intended to be within the spirit and scope of the disclosure. Accordingly, the foregoing description and drawings are by way of example only.

What is claimed is:

1. A centrifugal blast wheel machine comprising:

a wheel assembly having a plurality of blades configured to throw blast media introduced into the wheel assembly against a work piece;

an impeller positioned about an axis of the wheel assembly, the impeller having a media inlet at one end adapted to receive blast media and a plurality of impeller media outlets constructed and arranged to allow egress of blast media upon rotation of the impeller;

a motor coupled to the impeller to drive the rotation of the impeller and the wheel assembly; and a control cage surrounding the impeller and secured to the wheel assembly, the control cage including a cylindrical body defining an interior chamber, the cylindrical body having an opening formed therein to allow the egress of blast media from the interior chamber, wherein the impeller includes a hub provided at one end of the impeller, the hub being configured to be coupled to the motor, a ring provided at an opposite end of the hub, the ring defining a media inlet to receive blast media, and a plurality of cylindrical vanes positioned between the hub and the ring, the plurality of cylindrical vanes being spaced from one another on peripheries of the hub and the ring, the plurality of cylindrical vanes defining a plurality of impeller media outlets constructed and arranged to allow egress of blast media upon rotation of the impeller.

2. The centrifugal blast wheel machine of claim 1, wherein the plurality of cylindrical vanes being spaced equidistant from one another on peripheries of the hub and the ring.

3. The centrifugal blast wheel machine of claim 2, wherein the plurality of cylindrical vanes is spaced from the control cage a predetermined distance.

4. The centrifugal blast wheel machine of claim 3, wherein the predetermined distance is at least 3 mm.

5. The centrifugal blast wheel machine of claim 3, wherein the plurality of cylindrical vanes includes eight cylindrical vanes.

6. The centrifugal blast wheel machine of claim 3, wherein each cylindrical vane has a diameter of 9 mm to 16 mm.

7. The centrifugal blast wheel machine of claim 6, wherein each vane of the plurality of cylindrical vanes is spaced apart from one another with a center-to-center distance dictated by the number of vanes.

8. An impeller for a centrifugal blast wheel machine, the impeller comprising:

a hub provided at one end of the impeller, the hub being configured to be coupled to the motor;

a ring provided at an opposite end of the hub, the ring defining a media inlet to receive blast media; and a plurality of cylindrical vanes positioned between the hub and the ring, the plurality of cylindrical vanes being spaced from one another on peripheries of the hub and the ring, the plurality of cylindrical vanes defining a plurality of impeller media outlets constructed and arranged to allow egress of blast media upon rotation of the impeller.

9. The impeller of claim 8, wherein the plurality of cylindrical vanes being spaced equidistant from one another on peripheries of the hub and the ring.

10. The impeller of claim 9, wherein the plurality of cylindrical vanes is spaced from a control cage a predetermined distance.

11. The impeller of claim 10, wherein the predetermined distance is at least 3 mm.

12. The impeller of claim 10, wherein the plurality of cylindrical vanes includes eight cylindrical vanes.

13. The impeller of claim 10, wherein each cylindrical vane has a diameter of 9 mm to 16 mm.

14. The impeller of claim 13, wherein each vane of the plurality of cylindrical vanes is spaced apart from one another with a center-to-center distance dictated by the number of vanes.

15. A method of operating a centrifugal blast wheel machine, the method comprising:

feeding blast media from a feed spout into an impeller of the centrifugal blast wheel machine;

accelerating the blast media by rotating the impeller giving rise to a centrifugal force that moves the blast media in radial direction, away from an axis of the impeller;

moving the blast media in a generally circular direction into a space between the impeller and a control cage;

metering an amount of blast media through an opening of the control cage onto blades of a blast wheel; and moving the blast media along lengths of the blades to accelerate and throw the blast media toward a work piece, wherein the impeller includes a hub provided at one end of the impeller, the hub being configured to be coupled to the motor, a ring provided at an opposite end of the hub, the ring defining a media inlet to receive blast media, and a plurality of cylindrical vanes positioned between the hub and the ring, the plurality of cylindrical vanes being spaced from one another on peripheries of the hub and the ring, the plurality of cylindrical vanes defining a plurality of impeller media outlets constructed and arranged to allow egress of blast media upon rotation of the impeller.

16. The method of claim 15, wherein the plurality of cylindrical vanes being spaced equidistant from one another on peripheries of the hub and the ring.

17. The method of claim 16, wherein the plurality of cylindrical vanes is spaced from the control cage a predetermined distance.

18. The method of claim 17, wherein the predetermined distance is at least 3 mm.

19. The method of claim 17, wherein the plurality of cylindrical vanes includes eight cylindrical vanes.

20. The method of claim 17, wherein each cylindrical vane has a diameter of 9 mm to 16 mm.

* * * * *